US009464546B2

(12) United States Patent
Perrot et al.

(10) Patent No.: US 9,464,546 B2
(45) Date of Patent: Oct. 11, 2016

(54) ASSEMBLY FOR PURIFYING EXHAUST GASES

(75) Inventors: Yohann Perrot, Belleville-en-Caux (FR); Jean-Paul Brunel, Meslieres (FR)

(73) Assignee: Faurecia Systemes D'Echappement, Nanterre (FR)

( * ) Notice: Subject to any disclaimer, the term of this patent is extended or adjusted under 35 U.S.C. 154(b) by 122 days.

(21) Appl. No.: 14/130,521

(22) PCT Filed: Jul. 5, 2012

(86) PCT No.: PCT/EP2012/063084

§ 371 (c)(1),
(2), (4) Date: Apr. 25, 2014

(87) PCT Pub. No.: WO2013/004769

PCT Pub. Date: Jan. 10, 2013

(65) Prior Publication Data

US 2014/0230418 A1 Aug. 21, 2014

(30) Foreign Application Priority Data

Jul. 5, 2011 (FR) ..... 11 56061

(51) Int. Cl.

| | |
|---|---|
| ***F01N 13/08*** | (2010.01) |
| ***F01N 1/08*** | (2006.01) |
| ***F01N 3/28*** | (2006.01) |
| ***F01N 13/02*** | (2010.01) |
| ***B01F 5/04*** | (2006.01) |
| ***B01F 5/06*** | (2006.01) |
| ***B01F 3/04*** | (2006.01) |

(52) U.S. Cl.

CPC ..... *F01N 1/08* (2013.01); *B01F 3/04049* (2013.01); *B01F 5/0473* (2013.01); *B01F 5/0654* (2013.01); *F01N 1/083* (2013.01); *F01N 3/2892* (2013.01); *F01N 13/02* (2013.01); *F01N 2240/20* (2013.01); *F01N 2240/36* (2013.01)

(58) Field of Classification Search

CPC .... F01N 1/083; F01N 3/2892; F01N 13/009; F01N 13/0093; F01N 13/0097; F01N 2240/20; F01N 2470/08; F01N 2470/22; F01N 1/082; F01N 1/084; F01N 1/086; F01N 1/088; F01N 2470/30

See application file for complete search history.

(56) References Cited

U.S. PATENT DOCUMENTS

2010/0083643 A1* 4/2010 Hayashi et al. ..... 60/297
2010/0223916 A1 9/2010 Hayashi

FOREIGN PATENT DOCUMENTS

DE 10 2009 056183 A1 6/2011
FR 2 900 962 A1 11/2007
GB 2452249 A * 3/2009 ..... B01F 3/04049
WO 2006096098 A1 9/2006

OTHER PUBLICATIONS

International search report dated Sep. 6, 2012.

* cited by examiner

*Primary Examiner* — Jonathan Matthias
(74) *Attorney, Agent, or Firm* — Carlson, Gaskey & Olds, PC

(57) ABSTRACT

The assembly for purification of exhaust gases comprises an upstream conduit and a downstream conduit positioned parallel to each other.

A space has an exhaust gas inlet communicating with the upstream conduit and an exhaust gas outlet communicating with the downstream conduit. A middle line divides the inlet into first and second areas providing a same passage section to the exhaust gases.

The assembly comprises a baffle covering at least 75% of the first area and covering less than 25% of the second area. The baffle and the space are laid out so that a portion of the exhaust gases penetrate through the first area of the inlet flows into the space along flow lines forming a cusp around the baffle.

23 Claims, 8 Drawing Sheets

ASSEMBLY FOR PURIFYING EXHAUST GASES

RELATED APPLICATION

This application is the U.S. national phase of PCT/EP2012/063084, filed Jul. 5, 2012, which claims priority to FR 11 56061, filed Jul. 5, 2011.

TECHNICAL FIELD

The present invention in general relates to exhaust lines of automobile vehicles. More specifically, the invention relates to an assembly for purifying exhaust gases, the assembly being of the type comprising an upstream conduit in which is housed a first unit for purifying exhaust gases; a downstream conduit in which is housed a second unit for purifying exhaust gases, the upstream conduit and the downstream conduit being positioned parallel to each other; a space having an exhaust gas inlet communicating with the upstream conduit and an exhaust gas outlet communicating with the downstream conduit, a middle line dividing said inlet into first and second areas providing a same passage section for the exhaust gas.

BACKGROUND

A purification assembly with upstream and downstream conduits as described above is known from DE 10 2010 014 037. In this document, the first and second units for purifying the exhaust gases are placed side by side, with their respective axes substantially parallel to each other. Such an arrangement is particularly compact. On the other hand, it is necessary to conform the space connecting the upstream conduit to the downstream conduit in order to obtain a relatively uniform distribution of the exhaust gases at the outlet of the space. Moreover, an injector of a product for reducing nitrogen oxides is provided in DE 10 2010 014 037. This injector injects said product into the space. The circulation of the exhaust gases should be provided so as to ensure proper dispersion of the product within the exhaust gases.

In order to ensure the functions described above, i.e. allowing a flow of exhaust gases such that these exhaust gases are distributed relatively uniformly at the outlet of the space and ensuring proper dispersion of the injected product in the exhaust gases, two cups, one covering the exhaust gas inlet and the other one the exhaust gas outlet, are provided in the space of patent DE 10 2010 014 037. The cup covering the exhaust gas inlet has radial orifices laid out so as to orient the exhaust gases penetrating through the inlet.

Such cups generate a high counter-pressure in the exhaust line.

SUMMARY

The invention provides a purification assembly in which the counter-pressure is lower.

For this purpose, the invention deals with an assembly for purifying exhaust gases of the aforementioned type. The assembly, for purifying exhaust gases, further comprises a baffle placed in a space facing the inlet. The baffle is in an orthogonal projection on the inlet and covers at least 75% of the first area and covers less than 25% of the second area. The baffle and the space are laid out so that a portion of the exhaust gases penetrating through the first portion of the inlet flows into the space following flow lines forming a cusp around the baffle.

In other words, the exhaust gases penetrating through the first portion of the inlet flow follow a U-shaped course. They first flow along the face of the baffle turned towards the inlet, as far as a free end of the baffle consisting in a cusp, and then flow in the opposite direction along the face of the baffle located opposite to the inlet. This flow induces internal rotation movements in the exhaust gases, which increase the turbulence level in the exhaust gas flow flowing along the face of the baffle located opposite to the inlet.

These turbulences, when the exhaust gas purification assembly is equipped with a device injecting a product for reducing nitrogen oxides, give the possibility of dispersing more rapidly the reducing product within the exhaust gases. The turbulences promote diffusion of the reducing product in the gas flow.

These turbulences are notably due to the fact that the exhaust gases penetrating through the second area of the inlet are practically not deflected by the baffle. On the contrary, the gases penetrating through the first area undergo two successive changes in direction. A first change in direction after penetrating into the space for flowing along the baffle, and then a second change in direction when the gases arrive at right angles to the second area of the inlet and mix with the flow penetrating through said second area. Thus, the gas flow from the first area penetrates into the gas flow from the second area with a high angle of incidence, for example close to 90°, which contributes to increasing the turbulence level.

This turbulence level is obtained without generating any high counter-pressure in the exhaust line, since the exhaust gases penetrating through the second area are practically not deflected by the baffle.

The first unit for purifying the exhaust gases is typically an oxidation catalyst that is specially adapted for diesel engines, known under the acronym of DOC. Alternatively, the upstream conduit includes several units for purifying exhaust gases, with notably a particle filter and one or several oxidation or reduction catalysts.

The second purification unit is a catalyst known under the name of SCR (Selective Catalytic Reduction) catalyst. The SCR catalyst is provided for reducing NO contained in the exhaust gases into nitrogen gas $N_2$, in the presence of ammonia $NH_3$. The downstream conduit may also include not only an SCR catalyst, but also a particle filter and/or one or several other catalysts or reducing elements, placed in the downstream conduit either upstream or downstream from the SCR catalyst.

As indicated above, the upstream conduit and the downstream conduit are placed parallel to each other. By this it is understood that for reasons of compactness, the upstream conduit and the downstream conduit are laid out side by side. More specifically, the respective portions of the upstream conduit and of the downstream conduit located in proximity to the space are placed side by side. These portions typically comprise the first and second purification units. The term of side by side is used here as meaning that the respective central axes of the upstream conduit and of the downstream conduit are substantially parallel to each other, or slightly tilted relatively to each other. The upstream and downstream conduits are located facing each other. In other words, the upstream and downstream conduits have respective side surfaces substantially facing each other.

The fact that the baffle in an orthogonal projection on the inlet covers at least 75% of the first area and covers less than 25% of the second area, means that it is important for the invention that the baffle deflects a large portion of the gases penetrating into the space through the first area. In order that the purification assembly does not generate too large of a counter-pressure, the baffle should on the contrary not deflect the exhaust gases penetrating through the second area, and thus only cover a small fraction of this second area. In order to attain this result, in the baffle, facing the first area of the inlet, provision is made for a solid portion or only including one or several orifices of small sizes.

For example, the baffle does not at all extend facing the second area. Alternatively, the baffle slightly extends facing the second area and only covers a small portion of this second area, so as not to interfere with the circulation of the exhaust gases penetrating through the second area.

In this case, the portion of the baffle located facing the second area delimits a large size aperture between a free edge of the baffle and the wall of the space. With this large size aperture, it is possible to let through the exhaust gases arriving from the inlet with minimum counter-pressure. Alternatively, the portion of the baffle located facing the second area delimits several large size apertures, between a free edge of the baffle and the wall of the space. The apertures are separate from each other. These large size apertures may be two, three or more than three in number.

Alternatively, the large size aperture(s) is(are) entirely made in the baffle, and are not delimited by a free edge of the baffles on the one hand and by the wall of the space on the other hand.

By orthogonal projection on the inlet, is meant the projection along a direction perpendicular to the plane in which the inlet is included.

The middle line mentioned above is a fictitious line and does not correspond to a line physically dividing the inlet into two separate areas. Reference is made to this middle line only with view to characterizing the invention. This simply reflects the fact that the baffle is provided for essentially covering one half of the inlet, and for only slightly extending on the other half of the inlet.

Preferably, the deflector covers at least 75% of the first area, still preferably at least 85% of the first area, and still preferably at least 90% of the first area. The baffle covers less than 25% of the second area, preferably less than 15% of the second area and still preferably less than 10% of the second area.

Typically the baffle has facing the first area a plurality of orifices. These orifices are small size orifices, clearly smaller than the aperture located facing the second area. All in all, the cumulated surface area of all the orifices is less than 25% of the surface area of the first area, preferably less than 15% of the surface area of the first area, and still preferably less than 10% of the surface area of the first area.

These orifices allow a fraction of the exhaust gases entering the first area to follow a direct path, i.e. not being deflected by the baffle. These gases cross the baffle and will mix with the exhaust gas flow flowing down again along the face of the baffle opposite to the inlet. This contributes to increasing the turbulence level in the exhaust gases.

The volume and the baffle delimit together a passage path guiding the exhaust gases from the inlet to the outlet. This passage path successively includes several segments. The first segment corresponds to the area located between the baffle and the inlet.

The passage path typically comprises a convergent segment, with an upstream portion providing a relatively larger passage section to the exhaust gases and a downstream portion providing a relatively smaller passage section to the exhaust gases. Typically, the convergent segment has a passage section which decreases from the upstream side to the downstream side. This convergent segment, for example, corresponds to a segment delimited between the face of the baffle turned opposite to the inlet and a wall of the space. When the assembly comprises a device for injecting a product for reducing nitrogen oxides, the latter is mounted so as to inject the product in the downstream portion.

The fact of injecting the reducing product in a portion with a small passage section gives the possibility of facilitating the dispersion of the reducing product in the exhaust gases. Indeed, the distance for diffusion of the product from the injection point into the whole section of the passage path is reduced.

Preferably, the injecting device is laid out for injecting the reducing product in a segment delimited in respective areas facing the baffle and a wall of the space. Alternatively, an injection is immediately achieved downstream from said segment. This gives the possibility of extending the length covered by the gas between the injection points, also called sowing point, and the exhaust gas outlet. This promotes homogenization of the reducing product within the exhaust gas, and allows better distribution of the reducing product on the inlet face of the second purification unit.

Such an arrangement of the injection point is made possible only because of the presence of the baffle. Indeed, the baffle forms a protective screen preventing the return of the reducing product towards the inlet. It thus prevents the reducing product from diffusing as far as the first purification unit. This is particularly important when the first purification unit is an oxidation catalyst of the DOC type and that the injected reducing product is ammonia or a precursor of ammonia. Indeed, ammonia may be oxidized upon contacting DOC. A portion of the ammonia is then lost by reduction of the NOx. Moreover the ammonia oxidized on the DOC generates itself NOx.

In an advantageous alternative, the area of the baffle delimiting the segment in which is achieved the injection of the reducing product, or delimiting the segment downstream from which injection of the reducing product is achieved, is concave, with concavity turned towards said segment. For a given surface area, the section of the segment thus has a less elongated shape, closer to an oval, well adapted for allowing fast and efficient diffusion of the reducing product to all the veins of gas.

Preferably, the passage path includes a segment with a substantially tangential orientation relatively to the inlet, and/or a segment with a substantially tangential orientation relatively to the outlet. This gives the possibility of extending the length of the path covered by the exhaust gases between the injection point and the outlet. Indeed, the exhaust gases do not directly flow from a central area of the inlet to a central area of the outlet, in a straight line. The path for letting through the exhaust gases on the contrary passes into peripheral areas of the inlet and of the outlet which gives the possibility of laying out a longer passage path in a space with a determined shape.

Typically, the passage path has a substantially helical segment opening into the outlet. Typically, the substantially helical segment extends the segment with substantially tangential orientation as far as the outlet. This helical shape gives the possibility of further extending the path covered by the exhaust gases between the sowing point and the outlet. The helical segment also gives the possibility of imparting rotation to the exhaust gas around an axis substantially perpendicular to the outlet. This rotation contributes to reinforcing the turbulence level in the exhaust gases and therefore improving the mixing of the reducing product in the gas flow. This also contributes to homogenization of the distribution of the reducing product on the inlet face of the second purification unit.

Typically, the baffle is secured to an edge of the inlet. The baffle may be added onto the edge of the inlet, or made in the same material with the edge of the inlet. In the first case, the baffle is preferably formed in a drop of metal obtained by cutting out the inlet in the space. In the second case, the baffle is obtained by deforming a wall of the space, preferably at the moment when the inlet is cut out in the space.

The space typically comprises a support ring in which the inlet and the outlet are made, and a cap added onto the support ring. The support ring, for example, includes one or several planar portions, in which the inlet and the outlet are made. The cap on the contrary is a deep-drawn part, which is concave and caps the support ring. The different segments of the path for letting through the exhaust gases are obtained by shaping the cap. They are, for example, obtained by deep-drawing the cap.

The baffle is preferably made with the support ring in the same material.

In a particular embodiment of the invention, the baffle and the space delimit at the cusp around the cup a section, for letting through the exhaust gases, of less than 75% of a passage section of the inlet, preferably less than 50% of the passage section of the inlet. In other words, the passage section provided to the exhaust gases at the cusp, i.e. in the area where the exhaust gases have a travel practically at 180°, is reduced so as to increase the speed of the gases. This contributes to increasing the turbulence level of the exhaust gases downstream from the cusp.

In an exemplary embodiment, the passage path between the cusp point and the injection point has at least first and second segments having respective orientations forming relatively to each other an angle comprised between 30 and 90°. The exhaust gases thus undergo an additional change in direction, causing additional rotation of the exhaust gases, upstream from the injection point. This further improves the quality of the mixing between the reducing product and the exhaust gases. Preferably, the angle is comprised between 40 and 80°, and still preferably between 50 and 60°. Both segments are typically connected to each other through an arched segment. These segments may be placed upstream or downstream from the convergent segments or be part of the convergent segment. The first and second segments are typically rectilinear. Alternatively, the first and second segments are slightly arched.

In this case, the inlet and the outlet preferably have respective centers aligned along a main direction, the middle line defined above forming with the main direction an angle of less than 30°. Indeed, the space is typically elongated along the main direction, so that the passage path for the gases is itself with a general orientation along the main direction. The fact that the middle line of the inlet forms with the main direction an angle of less than 30° means that the solid portion of the baffle is substantially located on one side of the main direction and that the aperture(s) of large sizes delimited by the baffle is(are) substantially located on the other side of the main direction. This gives the possibility of placing the first segment in an orientation which is substantially perpendicular to the main direction, and the second segment substantially parallel to the main direction. The convergent segment in this case is very short and is placed upstream from the first segment.

With such an arrangement, it is possible to place the injection point very much upstream, so as to further increase the available distance for homogenizing the reducing product and the exhaust gases.

The passage path may have upstream from the injection point other segments having other orientations.

Preferably, the injection device is provided for injecting into the space a gaseous product which reduces nitrogen oxides, typically ammonia. Alternatively, the device is provided for injecting a liquid product, for example a solution of ammonia or urea.

These and other features may be best understood from the following drawings and specification.

BRIEF DESCRIPTION OF THE DRAWINGS

Other features and advantages of the invention will become apparent from the detailed description which is given thereof below, as an indication and by no means as a limitation, with reference to the appended figures, wherein.

DETAILED DESCRIPTION

The assembly 1 illustrated in FIGS. 1 to 4 is intended for purifying exhaust gases from a heat engine of an automobile vehicle. It is more particularly intended for purifying exhaust gases from a diesel engine.

Figure 3:
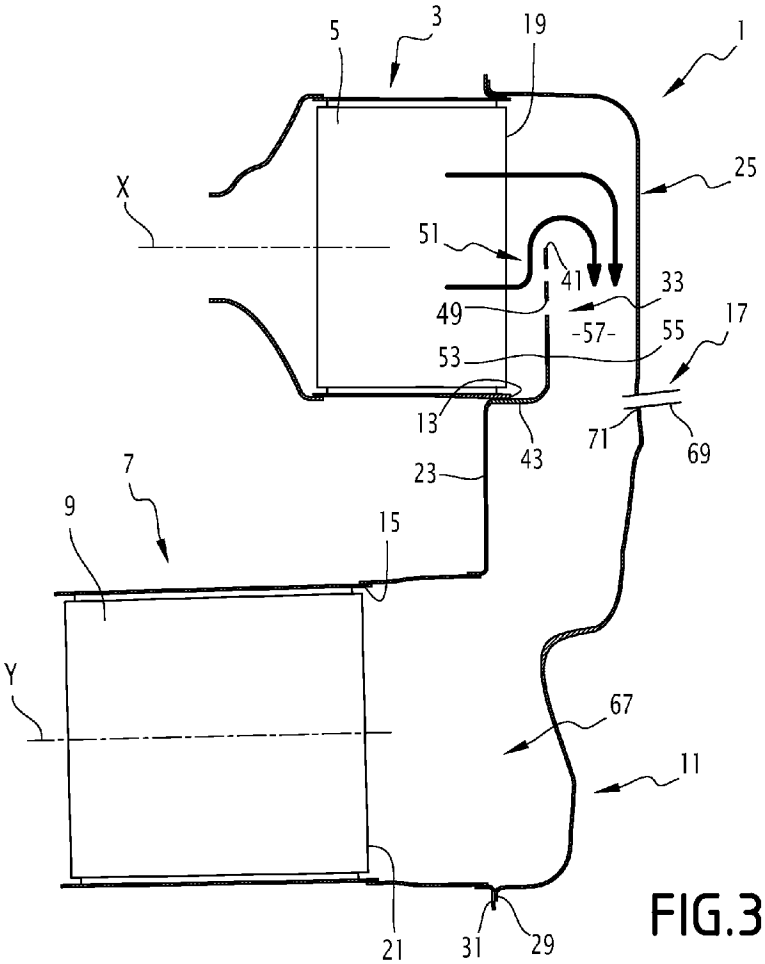
FIG. 3 is a sectional view, taken along the broken line III of FIG. 2.

As this is visible in FIG. 3, the assembly 1 comprises an upstream conduit 3 in which is housed a first unit 5 for purifying the exhaust gases; a downstream conduit 7 in which is housed a second unit 9 for purifying the exhaust gases; a space 11 having an exhaust gas inlet 13 communicating with the upstream conduit 3, and an exhaust gas outlet 15 communicating with the downstream conduit 7; and an injector 17 adapted for injecting ammonia into the space 11.

The upstream conduit 3 is connected towards the upstream side to an exhaust manifold (not shown) which collects the exhaust gases flowing out of the combustion chambers of the heat engine. Other pieces of equipment are optionally interposed between the upstream conduit and the exhaust manifold, for example a turbo compressor.

The first purification unit 5 is an oxidation catalyst for a diesel engine (DOC). It is laid out inside the upstream conduit 3 so that the exhaust gases are forced to cross the catalyst 5 when these exhaust gases circulate from the exhaust manifold to the inlet 13. The catalyst 5 has an outlet face 19 through which the exhaust gases leave the catalyst. The face 19 substantially coincides with the inlet 13. The upstream conduit 3 directly opens into the inlet 13. Alternatively, the outlet face 19 is shifted upstream, slightly at a distance from the inlet 13.

The downstream conduit 7 is connected towards the downstream side to an exhaust cannula (not shown) through which the exhaust gases are released into the atmosphere after purification. Other pieces of equipment, such as mufflers are inserted between the downstream conduit and the exhaust cannula.

The second purification unit 9 is a catalyst known under the name of SCR: Selective Catalytic Reduction. The catalyst 9 is laid out in the downstream conduit so that the exhaust gases flowing out through the outlet 15 and circulating towards the cannula are forced to cross the SCR catalyst 9. The catalyst 9 has an inlet face 21 through which the exhaust gases penetrate the inside of the catalyst 9. This inlet face 21 is substantially located in coincidence with the outlet 15. Alternatively, the inlet face is shifted along the downstream conduit, at a distance from the outlet 15. Alternatively, a particle filter or another catalyst is interposed between the outlet 15 and the SCR catalyst 9.

The upstream conduit 3 and the downstream conduit 7 are substantially parallel to each other. They are juxtaposed one beside the other. Their respective central axes referenced as X and Y in FIG. 3, are substantially parallel to each other. The exhaust gases circulate in opposite directions relatively to each other through the first catalyst 5 and through the second catalyst 9.

The space 11 is provided for guiding the exhaust gases from the inlet 13 to the outlet 15. It includes a support ring 23 in which the inlet 13 and the outlet 15 are made, and a cap 25 added onto the support ring.

Figure 2:
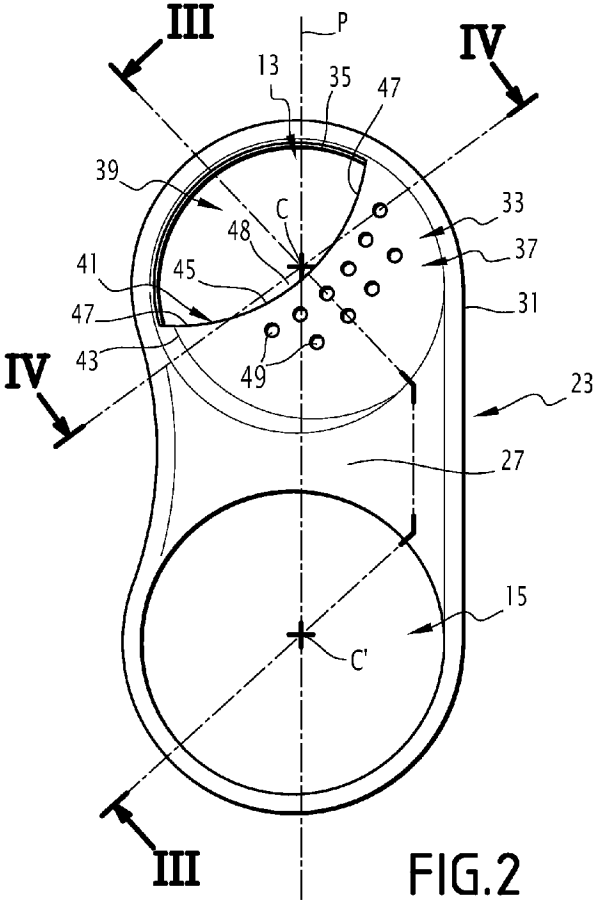
FIG. 2 is a front view of the assembly of FIG. 1, the cap not being illustrated in order to show the inlet, the outlet and the baffle.

The support ring 23 is a metal deep-drawn part. The inlet 13 and the outlet 15 are for example circular. They are located in a same plane or in two planes parallel to each other and slightly shifted relatively to each other as illustrated in FIG. 3. The support ring 23 has an elongated shape along a main direction P passing through the respective centers C and C' of in the inlet 13 and of the outlet 15 (FIG. 2). The inlet and the outlet occupy two ends of the support ring. The inlet 13 substantially occupies a whole end of the support ring, and the outlet 15 similarly occupies a whole second end of the support ring. The support ring on the other hand includes a solid central portion 27, between the inlet and the outlet. The width of the central portion 27, taken parallel to the main direction, is dictated by the distance between the upstream and downstream conduits.

The cap 25 is a metal deep-drawn part of concave shape. It thus has an internal volume of a complex shape, and an aperture delimited by a peripheral edge 29. The support ring 23 closes the aperture, the peripheral edge 31 of the support ring being sealably assembled to the peripheral edge 29 of the aperture. For example, the edges 29 and 31 are sealably welded to each other.

The assembly 1 further includes a baffle 33 placed in the space 11, facing the inlet 13. The baffle 33 is secured to the peripheral edge 35 of the inlet. It is obtained during the deep-drawing of the support ring. The baffle 33 moves away from the plane of the inlet 3 from the edge 35, towards the inside of the space 11.

In the illustrated example, the baffle 33 extends facing substantially half of the inlet 13. Thus, if the illustration of FIG. 2 is considered, the middle line corresponding to the sectional plane IV divides the inlet 13 into first and second areas 37 and 39 substantially providing a same section for letting through the exhaust gas. Considered as an orthogonal projection on the inlet 13, like in FIG. 2, the baffle 33 covers the quasi-totality of the first area 37, and only covers a very small portion of the second area 39. The baffle 33 thus defines with the cap 25 a wide aperture for letting through the exhaust gases entering through the second area 39 while it deflects the quasi-totality of the exhaust gases entering through the first area 37.

More specifically, the baffle has a free edge 41, and an edge 43 bound to the peripheral edge 35 of the inlet 13.

The free edge 41, considered as a projection on the inlet 13 like in FIG. 2, has a central portion 45 extending into the first area 37, in close proximity to the center C of the inlet, and two end portions 47 extending into the second area 39. The surface 48 of the first area extending between the central portion 45 and the sectional plane IV is not covered by the baffle. This surface has an extremely reduced surface area.

The surfaces of the second area 39 extending between the end portions 47 and the sectional plane IV are on the other hand covered by the baffle 33. These portions are of reduced surface area.

The baffle 33 includes, as this is visible in FIG. 2, a plurality of orifices 49. The orifices 49 are of a small size relatively to the size of the inlet 13. The total surface area of the surface 48, comprised between the portion 45 of the free edge and the plane IV and of the different orifices 49 is less than 25% of the surface of the first area. In other words, the baffle considered as an orthogonal projection on the inlet covers at least 75% of the first area.

As visible in FIGS. 1 to 4, the space 11 and the baffle 33 together define a passage path for the exhaust gases from the inlet 13 as far as the outlet 15. This passage path is conformed to ensure excellent mixing quality of the ammonia gas injected by the injection device 17 into the exhaust gases. The passage path first includes an inlet segment 51 between the baffle 33 and the inlet 13. In the inlet segment 51, the exhaust gases penetrating through the first area 37 of the inlet are deflected by the baffle 33 towards the second area 39 of the inlet. They flow along one face 53 of the baffle turned towards the inlet 13. Upon arriving at the free edge 41, said exhaust gases flow along flow lines forming a cusp around the deflector, and more specifically around the free edge 41 of the baffle. Thus, the flow lines will have cusps at 180°. The exhaust gases, after having crossed the free edge 41 flow along the face 55 of the baffle opposite to the inlet 13. The exhaust gases therefore flow in the reverse direction along the face 53 and along the face 55.

The exhaust gases entering through the second area 39 are practically not deflected by the baffle 33. After having crossed the free edge 41, they flow along the face 55 of the baffle opposite to the inlet 13.

Thus, the passage path of the exhaust gases has after the inlet segment 51, a convergent segment 57 delimited on one side by the baffle 33 and on the other side by the cap 25. More specifically, the convergent segment 57 is delimited by areas of the cap and of the baffle placed facing each other. The area 59 of the baffle delimiting the convergent segment has concavity visible in FIG. 4. In other words, taken as a section in a plane perpendicular to the inlet and containing the middle line mentioned above, the area 59 has a concavity turned towards the segment 57.

This segment 57 has a convergent shape. More specifically, the passage section provided for the exhaust gas along the second segment 57 decreases along this segment 57 from upstream to downstream. Upstream and downstream are appreciated here relatively to the normal direction of circulation of the exhaust gases. This is particularly well visible in FIG. 1.

This reduction of the passage section is obtained by suitable shaping of the cap 25.

The passage path also comprises a segment 61, extending the convergent segment 57, with tangential orientation relatively to the inlet 13 and relatively to the outlet 15. This segment is visible in FIG. 1. The upstream portion of the segment 61, which is connected to the convergent section 57 is substantially tangential to the inlet 13. The downstream portion 65 is substantially tangential to the outlet 15. The segment 61 is substantially rectilinear. It is substantially parallel to the main direction P and extends along an edge of the support ring.

The passage path further includes a helical segment 67, extending the tangential segment 61. The helical segment 67 is wound around the central axis Y of the downstream outlet conduit 7. It opens into the outlet 15. The tangential segment 61 and the helical segment 67 are obtained by suitable shaping of the cap 25.

Figure 1:
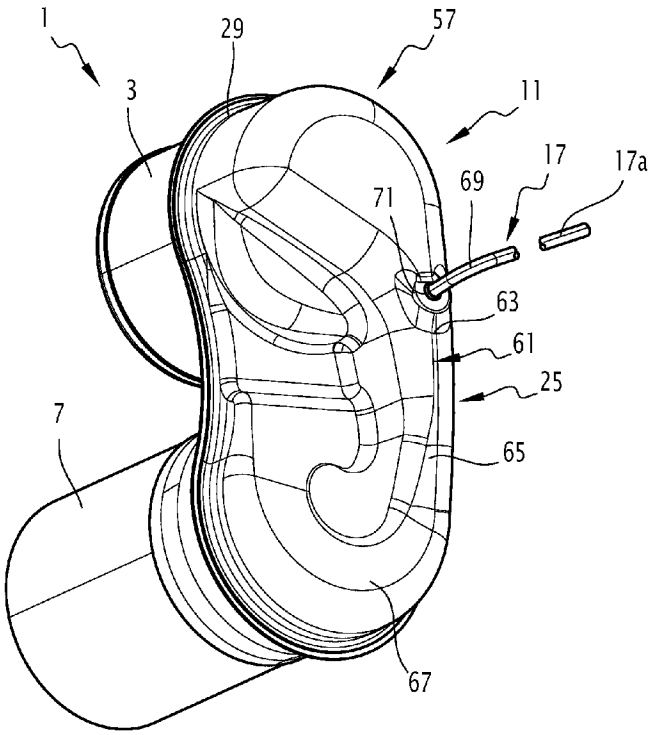
FIG. 1 is a perspective view of a purification assembly according to a first embodiment of the invention.
Figure 4:
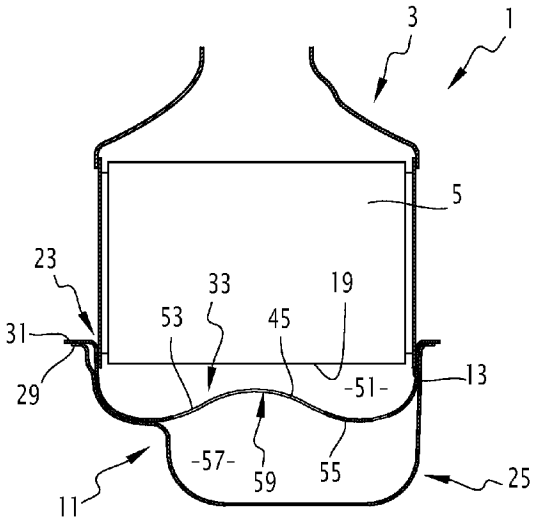
FIG. 4 is a sectional view, taken along the line IV materialized in FIG. 2.

The ammonia injecting device 17 comprises a unit 17*a* for generating ammonia gas, shown schematically in FIG. 1, and a conduit 69 added onto the cap 25. The cap has for this purpose an orifice 71 on the edge of which is attached the conduit 69. Preferably, the conduit 69 slightly penetrates the inside of the space 11. The unit generating ammonia gas is, for example, a cartridge for storing ammonia gas, or a cartridge for storing ammonia by absorption on a suitable solid material, or a reactor provided for generating ammonia from a liquid material such as urea. The orifice 71 is positioned to achieve the injection of ammonia gas in a point of the passage path in which the passage section provided to the exhaust gas is reduced. This point for example corresponds to the downstream end of the convergent segment 57, or to the end 63 of the tangential segment 61.

Figure 5:
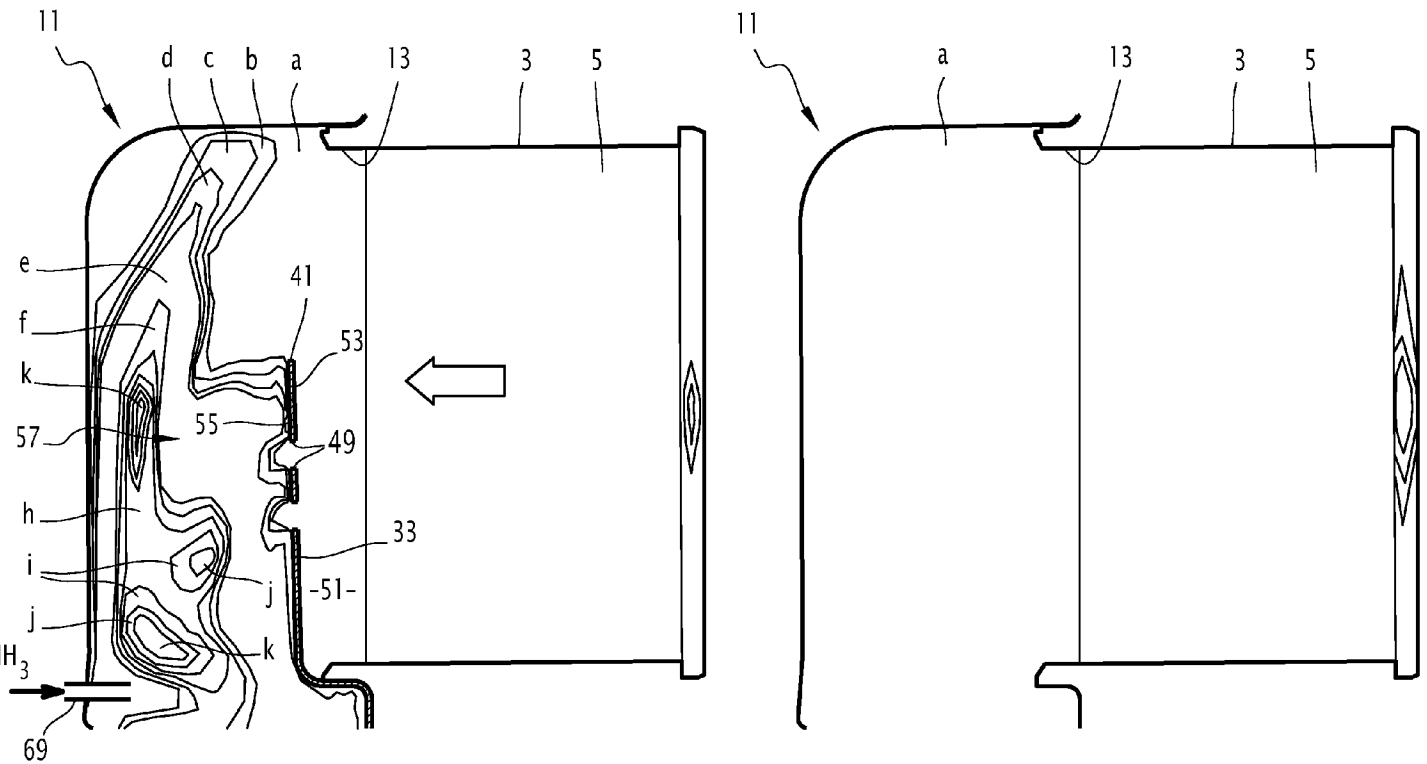
FIG. 5 is a graphic illustration of the turbulence level in the exhaust gases for an assembly with a baffle on the left portion of FIG. 5, for an assembly without any baffle on the right portion of FIG. 5.

FIG. 5 shows that the turbulence level in the flow of exhaust gases at the injection point is considerably increased because of the presence of the baffle 33. On the right portion of FIG. 5, the turbulence level of the exhaust gases is illustrated for an assembly for purifying exhaust gases having the same geometry as the one of the invention, without a baffle. The turbulence level is low in the space 11 and is substantially constant. On the left portion of FIG. 5, the turbulence level in the assembly of the invention including a baffle is illustrated. The turbulence level is indicated by a graduated index from a to k, k being the maximum turbulence level. This figure shows significant turbulence level at the downstream end of the convergent segment. As explained above, this turbulence level is explained by the fact that the exhaust gases penetrating into the space 11 through the first area of the inlet undergo several changes in direction, notably a turnaround around the baffle, which generates internal rotation in the exhaust gases at the injection point.

In FIG. 5, only one half of the purification assembly has been illustrated. This half essentially corresponds to the upper portion of FIG. 3.

Figure 6:
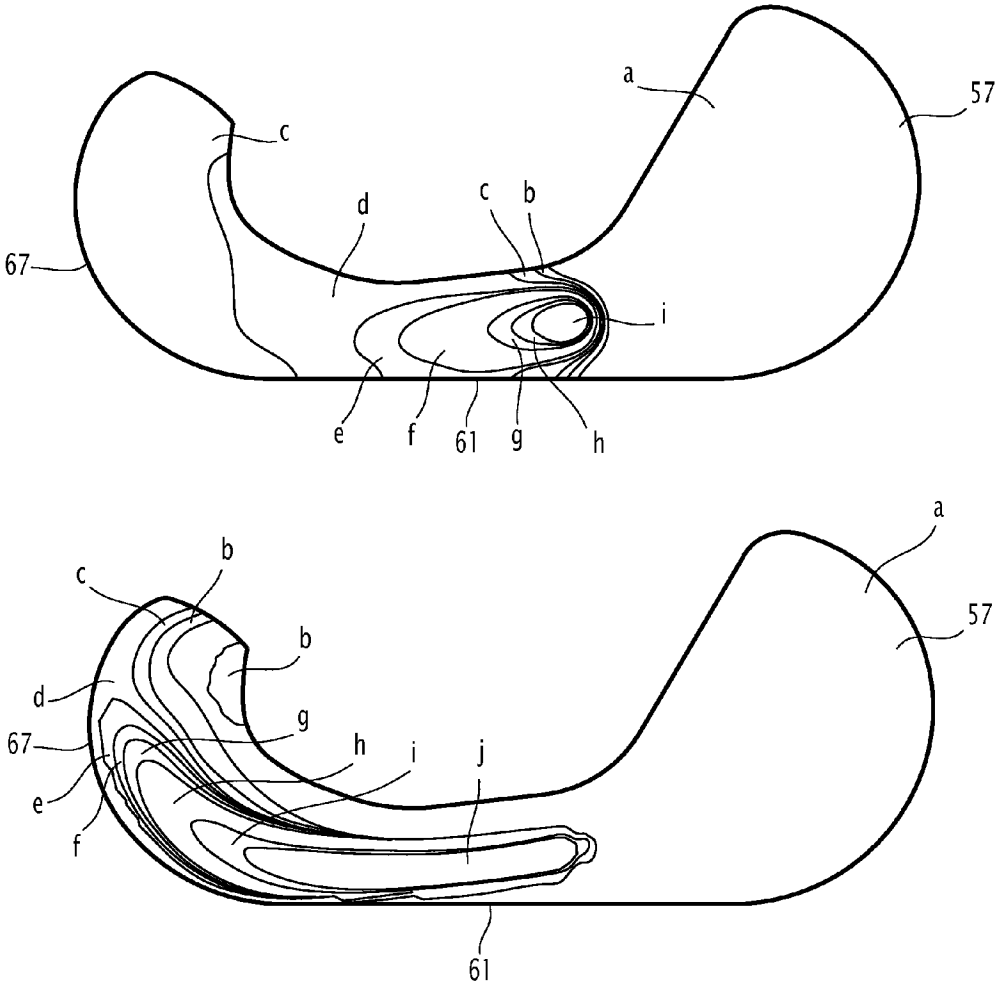
FIG. 6 is a graphic illustration giving the $NH_3$ gas concentration in the exhaust gases along the passage path, at the top with a baffle, and at the bottom without any baffle.

FIG. 6 shows that, because of the turbulence level in the exhaust gases, the $NH_3$ gas injected in the space 11 is very rapidly homogenized in the exhaust gas flow. The lower portion shows the concentration of $NH_3$ inside the volume 11, for an assembly without any baffle corresponding to that of FIG. 5. The other portion of FIG. 6 shows the concentration of $NH_3$ in the space 11 for an assembly with a baffle according to the invention.

In both cases the $NH_3$ concentration is expressed by an index graduated from a to i, i corresponding to the maximum $NH_3$ concentration.

The diagrams of FIG. 6 correspond to front views of the assembly for purifying exhaust gases, similar to the view of FIG. 2. The exhaust gas inlet is located on the right and the exhaust gas outlet on the left. The lower portion of FIG. 6 shows that, without the baffle, a vein of exhaust gas with a high concentration of $NH_3$ exists which extends far along the exhaust path, substantially as far as half the helical segment.

The upper portion of FIG. 6 shows that with the baffle, the decrease in the $NH_3$ concentration in the exhaust gases is very rapid. The exhaust gas vein with a high $NH_3$ concentration disappears far before the helical segment 67.

Figure 7:
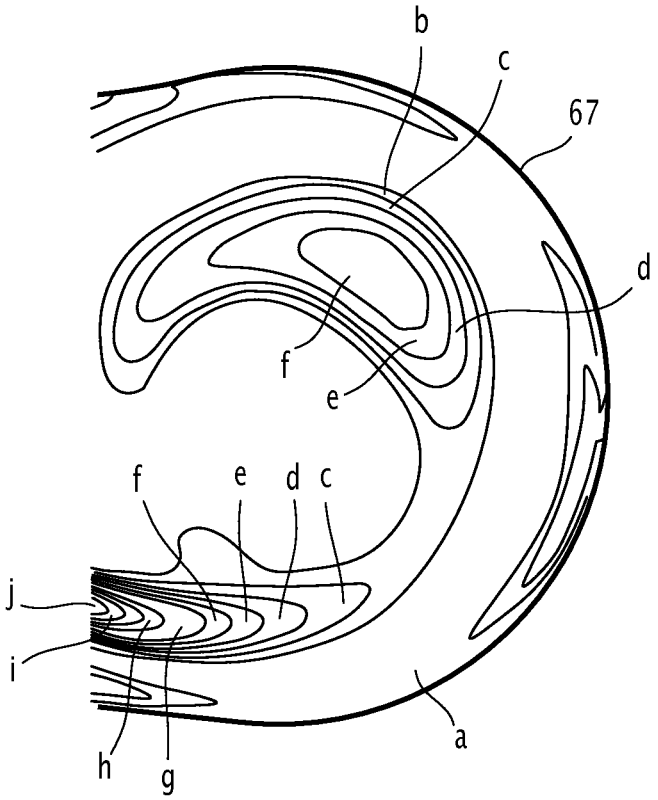
FIG. 7 is an illustration of the helical segment of the path for letting through the exhaust gases, graphically showing the turbulence level of the exhaust gases.

FIG. 7 shows that the helical segment 67 allows an increase in the turbulence level of the exhaust gases. In FIG. 7, the turbulence level is indicated by an index graduated from a to j, j corresponding to the maximum turbulence level.

FIG. 7 shows that the turbulence level decreases when the exhaust gases leave the tangential segment 61 and penetrate into the helical segment 67. It then tends to increase along the helical segment 67 because of the setting into rotation of the exhaust gases.

Figure 8:
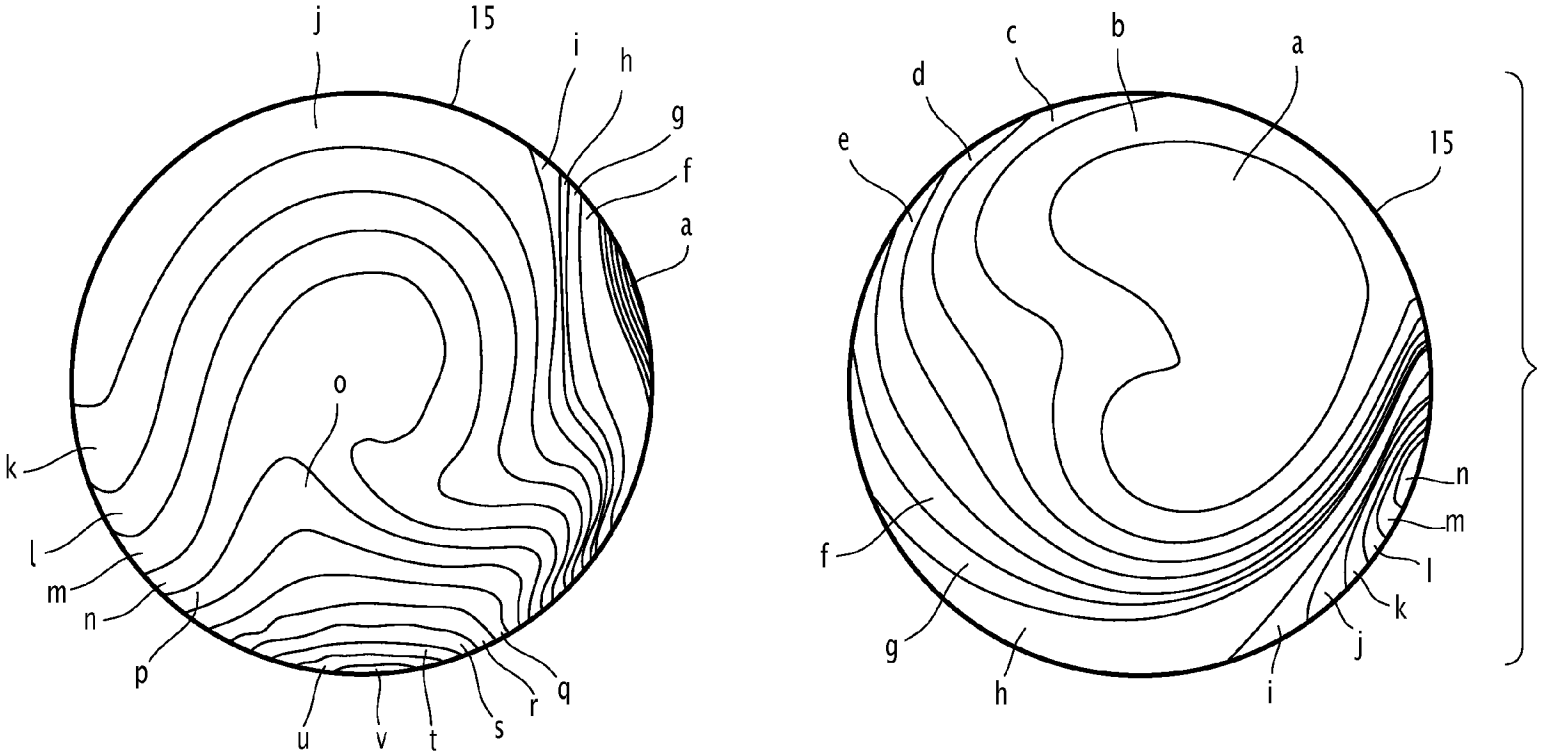
FIG. 8 is a graphic illustration of the distribution of ammonia at the outlet of the space, on the left portion for an assembly equipped with a baffle and on the right portion for an assembly not including any baffle.

FIG. 8 shows the distribution of the ammonia $NH_3$ in the plane of the outlet 15 of the space. On the right portion, the diagram corresponds to a purification assembly without any baffle, as illustrated on the right portion of FIG. 5. On the left portion of FIG. 8, the diagram corresponds to the invention, i.e. to an assembly equipped with a baffle. The molar concentration of $NH_3$ is indicated by an index graduated from a to v, v being the maximum concentration. The scales are different from each other on the left diagram and on the right diagram.

The right portion of FIG. 8 shows that, in the absence of a baffle, the ammonia $NH_3$ is much more concentrated below and on the right of the outlet than in the central area of this outlet. The molar fraction of $NH_3$ is more than four times higher below and on the right of the outlet than in the central portion of the latter.

The left portion, of FIG. 8 shows that, with a baffle, the distribution of $NH_3$ is relatively homogeneous in the plane of the outlet. The ratio of the $NH_3$ molar fraction in the area having the highest concentration over the $NH_3$ molar fraction in the area having the lowest concentration is less than 1.2.

An alternative of the first embodiment will now be described, with reference to FIG. 9.

Only the points by which this alternative differs from the assembly illustrated in FIGS. 1 to 4 will be detailed below. Identical elements or assuring the same function will be designated with the same references.

Figure 9:
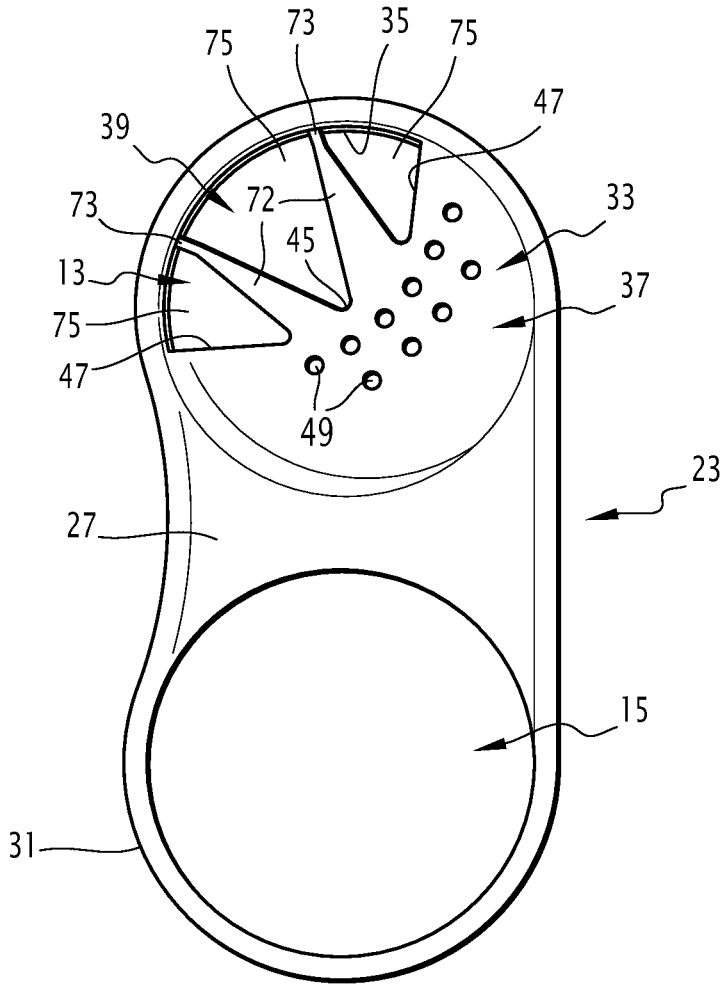
FIG. 9 is a view similar to that of FIG. 2, showing an alternative embodiment of the baffle.

In the alternative embodiment of FIG. 9, the baffle 33 includes two bows 72 essentially extending facing the second area 39 of the inlet. These bows 72 are secured to the central portion 45 of the free edge 41, and extend substantially radially as far as the points 73 of the edge 35 located along the second area of the inlet. The baffle 33 thus delimits three passages 75 for the exhaust gases arriving from the inlet 13.

The passage section for the exhaust gases at the cusp, i.e. between the free end 41 of the baffle and the cap 25 is reduced by the presence of the bows 72. This contributes to accelerating the flow velocity of the exhaust gases in this area, and to increasing the turbulence level of the exhaust gases at the injection point.

A second embodiment of the invention will now be described, with reference to FIGS. 10 and 11. Only the points by which the second embodiment differs from the first will be detailed below.

The identical elements or ensuring the same function in both embodiments will be designated with the same references.

Figure 10:
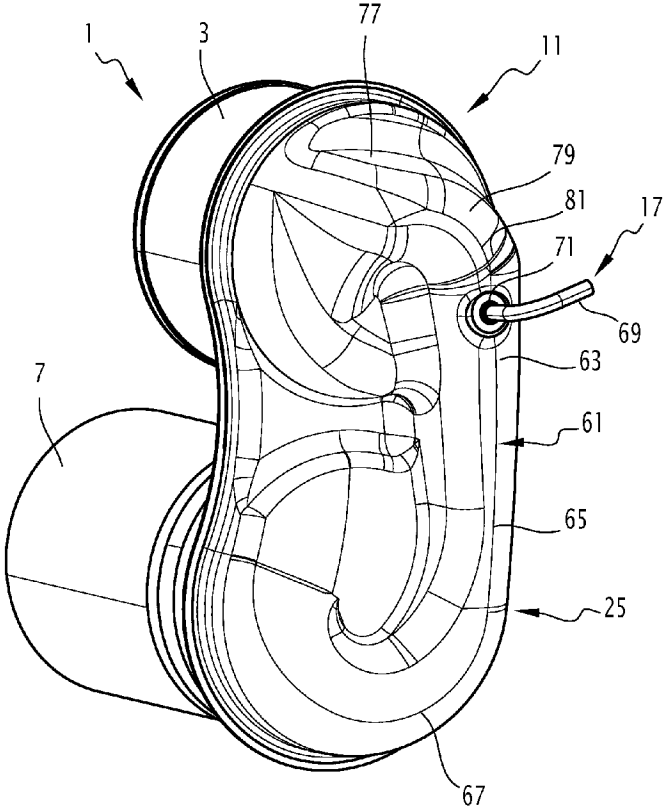

As visible in FIG. 10, the convergent segment 57 is replaced with a segment of more complex shape, laid out for further increasing the efficiency with which ammonia gas is dispersed in the exhaust gases. The convergent segment is replaced with a first segment 77 with a substantially perpendicular orientation to the main direction, extending by an arched segment 79, itself extending with a second segment 81 having an orientation substantially parallel to the main direction. The upstream end of the segment 77 is convergent, i.e. provides to the exhaust gas a passage section which decreases from upstream to downstream. The first segment 77 is substantially located at right angles to the second area of the inlet. The arched segment 79 and the second segment 81 are substantially located at right angles to the first area.

Figure 11:
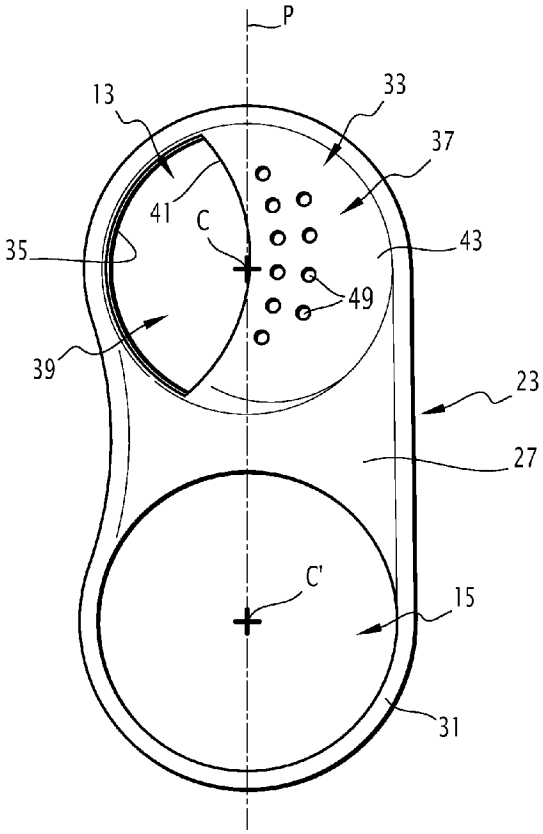
FIGS. 10 and 11 are views similar to FIGS. 1 and 2 for a second embodiment of the invention.

Moreover, as visible in FIG. 11, the baffle is slightly shifted in rotation around the center C of the inlet as compared with the situation of FIG. 2. The middle line allowing subdivision of the inlet into two areas of the same size, one substantially completely covered by the baffle and the other one practically not covered by the baffle, is aligned with the main direction or slightly tilted relatively to this main direction. This facilitates the layout of the segments 77, 79 and 81.

Finally the injection point of ammonia gas is shifted upstream along the passage path of the exhaust gases as compared with the first embodiment.

Although an embodiment of this invention has been disclosed, a worker of ordinary skill in this art would recognize that certain modifications would come within the scope of this disclosure. For that reason, the following claims should be studied to determine the true scope and content of this disclosure.

The invention claimed is:

1. An assembly for purification of exhaust gases, the assembly comprising:

an upstream conduit in which is housed a first unit for purification of exhaust gases;

a downstream conduit in which is housed a second unit for purification of exhaust gases, the upstream conduit and the downstream conduit being positioned parallel to each other;

a space having an exhaust gas inlet communicating with the upstream conduit and an exhaust gas outlet communicating with the downstream conduit, a middle line dividing said inlet into first and second areas providing respective equal passage sections to the exhaust gases; and wherein the assembly comprises a baffle comprising a first face turned towards the inlet and a second face facing away from the inlet, the baffle being arranged in the space facing the inlet, the baffle in an orthogonal projection on the inlet covering at least 75% of the first area and covering less than 25% of the second area, the baffle and the space being laid out so that a portion of the exhaust gases penetrating through the first area of the inlet flows into the space following flow lines forming a cusp around the baffle, the exhaust gases penetrating through the first area of the inlet, flowing along the first face of the baffle, then flowing in a reverse direction along the second face of the baffle.

2. The assembly according to claim 1, wherein the baffle has a plurality of orifices facing the first area.

3. The assembly according to claim 1, wherein the space and the baffle delimit a passage path guiding the exhaust gases from the inlet to the outlet, the passage path comprising a convergent segment having an upstream portion providing a relatively larger passage section to the exhaust gases and a downstream portion providing a relatively smaller passage section to the exhaust gases, the assembly comprising an injector configured to inject a product for reducing nitrogen oxides in the downstream portion.

4. The assembly according claim 1, wherein the space and the baffle delimit a passage path guiding the exhaust gases from the inlet to the outlet, the assembly comprising an injector configured to inject a product for reducing nitrogen oxides in or immediately downstream from a segment of said passage path, said segment being delimited by respective areas facing the baffle and a wall of the space.

5. The assembly according to claim 4, wherein said area of the baffle is concave towards said segment.

6. The assembly according to claim 1, wherein the space and the baffle delimit a passage path guiding the exhaust gases from the inlet to the outlet, said path having a segment of a tangential orientation relative to the inlet.

7. The assembly according to claim 1, wherein the space and the baffle delimit a passage path guiding the exhaust gases from the inlet to the outlet, said path having a segment of a tangential orientation relative to the outlet.

8. The assembly according to claim 1, wherein the space and the baffle delimit a passage path guiding the exhaust gases from the inlet to the outlet, said path having a helical segment opening into the outlet.

9. The assembly according to claim 1, wherein the baffle is secured to one edge of the inlet.

10. The assembly according to claim 1, wherein the space comprises a support ring in which the inlet and the outlet are made, and a cap added onto the support ring.

11. The assembly according to claim 10, wherein the baffle is made with the support ring in the same material.

12. The assembly according to claim 1, wherein the baffle and the space delimit at the cusp around the baffle a passage section for the exhaust gases, of less than 75% of a passage section of the inlet.

13. The assembly according to claim 1, wherein the space and the baffle delimit a passage path guiding the exhaust gases from the inlet to the outlet, the assembly comprising an injector configured to inject a product reducing nitrogen oxide in an injection point of said passage path, the passage path comprising between the cusp and the injection point at least first and second segments having respective orientations forming relatively to each other an angle comprised between 30° and 90°.

14. The assembly according to claim 1, wherein the inlet and the outlet have respective centers aligned along a main direction, said middle line forming with the main direction an angle of less than 30°.

15. The assembly according to claim 1, comprising an injector configured to inject a gaseous product reducing nitrogen oxides.

16. The assembly according to claim 1, wherein the baffle and the space delimit at the cusp around the baffle a passage section for the exhaust gases of less than 50% of a passage section of the inlet.

17. The assembly according to claim 1, including a convergent section delimited by the second face of the baffle on one side and on the other side by a cap, and an injector orifice configured to receive an injector to inject a product into the exhaust gases, the injector orifice being positioned downstream of the convergent section.

18. An assembly for purification of exhaust gases, the assembly comprising:

an upstream conduit including a first purification unit for exhaust gases;

a downstream conduit including a second purification unit for exhaust gases, the upstream conduit and the downstream conduit being positioned parallel to each other;

a space having an exhaust gas inlet communicating with the upstream conduit and an exhaust gas outlet communicating with the downstream conduit, a middle line dividing said inlet into first and second areas having respective equal passage sections to the exhaust gases;

a baffle having a first face facing the inlet and a second face facing away from the inlet, the baffle being arranged in the space to face the inlet, and wherein the baffle separates the exhaust gases into at least two different types of flow that are mixed together in a convergent section downstream of the baffle prior to exiting the exhaust gas outlet of the space.

19. The assembly according to claim 18, wherein the baffle has a first face facing the inlet and a second face facing opposite of the inlet, the baffle being arranged in the space facing the inlet, the baffle in an orthogonal projection on the inlet covering at least 75% of the first area and covering less than 25% of the second area, the baffle and the space being laid out so that a first portion of the exhaust gases engages the first face of the baffle as one flow type and a second portion of the exhaust gases flows around a cusp of the baffle in the second area and into the space as a second flow type.

20. The assembly according to claim 19, wherein one portion of the first portion of the exhaust gases penetrates through openings formed in the baffle with a remaining portion of the first portion flowing along the first face in a first direction toward the cusp, and wherein at least a portion of the second portion of the exhaust gases flows around the cusp and along the second face of the baffle in a second direction opposite of the first direction.

21. The assembly according to claim 18, wherein the convergent segment is delimited by the second face of the baffle on one side and on the other side by a cap, and wherein the convergent segment defines a passage section for the first and second portions of the exhaust gas that decreases in area along the convergent segment from an upstream direction to a downstream direction.

22. The assembly according to claim 18, including an injector orifice configured to receive an injector to inject a product into the exhaust gases, the injector orifice being positioned downstream of the convergent section.

23. An assembly for purification of exhaust gases, the assembly comprising:

an upstream conduit in which is housed a first unit for purification of exhaust gases;

a downstream conduit in which is housed a second unit for purification of exhaust gases, the upstream conduit and the downstream conduit being positioned parallel to each other;

a space having an exhaust gas inlet communicating with the upstream conduit and an exhaust gas outlet communicating with the downstream conduit, a middle line dividing said inlet into first and second areas providing respective equal passage sections to the exhaust gases;

wherein the assembly comprises a baffle, comprising a first face turned towards the inlet and a second face facing away from the inlet, the baffle being arranged in the space facing the inlet, the baffle in an orthogonal projection on the inlet covering at least 75% of the first area and covering less than 25% of the second area, the baffle and the space being laid out so that a portion of the exhaust gases penetrating through the first area of the inlet flows into the space following flow lines forming a cusp around the baffle, the exhaust gases penetrating through the first area of the inlet, flowing along the first face of the baffle, then flowing in a reverse direction along the second face of the baffle;

wherein the space and the baffle delimit a passage path guiding the exhaust gases from the inlet to the outlet, the passage path comprising a convergent segment having an upstream portion providing a passage section to the exhaust gases and a downstream portion providing a smaller passage section to the exhaust gases than the upstream portion, the assembly comprising an injector configured to inject a product for reducing nitrogen oxides in the downstream portion, and wherein said passage path includes a helical segment opening into the outlet.

* * * * *